US011506012B2

(12) United States Patent
Reinås et al.

(10) Patent No.: US 11,506,012 B2
(45) Date of Patent: Nov. 22, 2022

(54) SUBSEA WELLHEAD ASSEMBLY

(71) Applicant: EQUINOR ENERGY AS, Stavanger (NO)

(72) Inventors: Lorents Reinås, Stavanger (NO); Tore Geir Wernø, Sandnes (NO); Morten Sæther, Lillestrom (NO); Harald Sigurd Nesse, Sandnes (NO)

(73) Assignee: EQUINOR ENERGY AS, Stavanger (NO)

( * ) Notice: Subject to any disclaimer, the term of this patent is extended or adjusted under 35 U.S.C. 154(b) by 0 days.

(21) Appl. No.: 16/313,395

(22) PCT Filed: Jul. 5, 2017

(86) PCT No.: PCT/NO2017/050182
§ 371 (c)(1),
(2) Date: Dec. 26, 2018

(87) PCT Pub. No.: WO2018/009077
PCT Pub. Date: Jan. 11, 2018

(65) Prior Publication Data

US 2019/0162038 A1 May 30, 2019

(30) Foreign Application Priority Data

Jul. 5, 2016 (GB) ..... 1611695
May 19, 2017 (GB) ..... 1708056

(51) Int. Cl.
*E21B 33/038* (2006.01)
*E21B 33/035* (2006.01)

(52) U.S. Cl.
CPC ..... *E21B 33/038* (2013.01); *E21B 33/035* (2013.01)

(58) Field of Classification Search
CPC ..... E21B 33/035; E21B 33/038
See application file for complete search history.

(56) References Cited

U.S. PATENT DOCUMENTS 4,558,744 A * 12/1985 Gibb ..... E21B 7/185 405/226
4,830,541 A * 5/1989 Shatto ..... E02D 23/16 166/368

(Continued)

FOREIGN PATENT DOCUMENTS

GB 2 097 739 11/1982
WO 2012/002818 1/2012

(Continued)

OTHER PUBLICATIONS

He Dictionary of Petroleum Exploration, Drilling & Production by Norman J. Hyne, PennWell Corporation, Tulsa, Oklahoma 1991 (Year: 1991).*

(Continued)

*Primary Examiner* — James G Sayre
(74) *Attorney, Agent, or Firm* — Wenderoth, Lind & Ponack, L.L.P.

(57) ABSTRACT

A method of installing or removing a subsea wellhead assembly is provided. The method comprising providing a suction anchor that in use acts as a subsea well foundation, wherein the suction anchor comprises an outer suction skirt; and an inner member, wherein the inner member comprises a high pressure wellhead housing; and installing or removing the suction anchor together with the high pressure wellhead housing on or from a seabed.

18 Claims, 7 Drawing Sheets

(56) References Cited

U.S. PATENT DOCUMENTS

| | | | | |
|---|---|---|---|---|
| 2004/0079529 | A1 | 4/2004 | Bartlett | |
| 2012/0273213 | A1* | 11/2012 | Blalock | E21B 33/038 166/341 |
| 2012/0283213 | A1* | 11/2012 | Tommeraas | A61P 35/00 514/54 |
| 2016/0333641 | A1* | 11/2016 | Ellison | E21B 7/18 |
| 2017/0130547 | A1* | 5/2017 | Bhatnagar | E21B 33/038 |

FOREIGN PATENT DOCUMENTS

| | | | | |
|---|---|---|---|---|
| WO | 2013/167872 | | 11/2013 | |
| WO | 2015/054766 | | 4/2015 | |
| WO | 2015/118348 | | 8/2015 | |
| WO | WO 2015/118348 | * | 8/2015 | E21B 7/20 |
| WO | WO-2015118348 | A1 * | 8/2015 | E21B 7/18 |
| WO | 2017/155415 | | 9/2017 | |

OTHER PUBLICATIONS

International Search Report and Written Opinion of the International Searching Authority dated Sep. 14, 2017 in International (PCT) Application No. PCT/NO2017/050182.

IPO Search Report dated Aug. 8, 2016 in corresponding GB Application No. 1611695.6.

IPO Search and Examination Report dated Oct. 26, 2017 in corresponding GB Application No. 1708056.5.

* cited by examiner

SUBSEA WELLHEAD ASSEMBLY

The invention relates to a method of installing or uninstalling a subsea wellhead assembly, a suction anchor for forming a subsea wellhead assembly and/or a subsea wellhead installation or removal apparatus.

In many scenarios subsea wells and wellhead equipment require a foundation on which they can be located during use. The foundation is used to support the subsea well which extends into the seabed, the wellhead and associated wellhead equipment, such as a blowout preventer, casings or XT(Christmas trees). A known type of subsea foundation is the suction anchor. A suction anchor used as a subsea foundation comprises a skirt. The suction anchor is lowered onto the seabed and then sucked into the seabed by reducing the pressure inside the skirt. Once the suction anchor has been sucked into the seabed, other well components are mounted on the suction anchor so as to form a well that extends through the suction anchor into the seabed. There is a desire for alternative and/or improved ways of installing and/or uninstalling a subsea wellhead that is supported in use by a suction anchor foundation.

According to a first aspect, the present invention provides a method of installing or uninstalling (i.e. removing) a subsea wellhead system, the method comprising: providing a suction anchor that in use acts as a subsea well foundation, wherein the suction anchor comprises an outer suction skirt; and an inner member, wherein the inner member comprises a high pressure wellhead housing; and installing or removing the suction anchor together with the high pressure wellhead housing on or from a seabed.

The inner member may be (at least in part) integral with the outer suction skirt.

The inner member may also comprise a conductor. The conductor may comprise a conductor housing and optionally a conductor pipe.

The conductor, e.g. the conductor housing, may be fixed (e.g. mechanically fixed) such as bolted, clamped, locked or glued etc to the suction anchor. Alternatively the conductor may be an integral part of the suction anchor, e.g. it may be welded thereto or integrally formed with the suction anchor. The conductor may support a conductor pipe. This may be by the conductor housing being welded to or integrally formed with the conductor pipe.

The inner member may comprise a central tube in which the conductor and/or high pressure wellhead housing are received. This may be a central tube that is used to form the annular volume in the suction anchor in which the suction may be created, i.e. a central suction anchor tube. This central tube may be additional to the conductor (if present) and the high pressure wellhead housing. The central tube may be integral to the suction anchor, e.g. integrally formed with or welded to the suction anchor.

The high pressure wellhead housing may be received in and landed on the conductor, e.g. the conductor housing. The high pressure wellhead housing may be mechanically fixed to the conductor such as bolted, clamped or locked to the conductor, e.g. conductor housing.

The high pressure wellhead housing may support a wellhead extension pipe. This may be by the high pressure wellhead housing being welded to or integrally formed with the wellhead extension pipe. The high pressure wellhead housing and supported wellhead extension pipe may together be referred to as a high pressure wellhead housing assembly.

The high pressure wellhead housing, and conductor (e.g. conductor housing and/or conductor pipe) if present, may be installed and removed together with the suction anchor. The high pressure wellhead housing, and conductor (e.g. conductor housing and/or conductor pipe) if present, may pre-installed.

According to another aspect the present invention may provide a method of installing (at least part of) a subsea wellhead assembly, the method comprising: providing a suction anchor for forming (at least part of) a subsea well foundation that is to be sucked into a seabed that comprises an outer suction skirt; and an inner member integral with the outer suction skirt, wherein the inner member comprises a high pressure wellhead housing (which may optionally support a wellhead extension pipe to form a high pressure wellhead housing assembly); and installing the suction anchor on the seabed to form a subsea well foundation with a high pressure wellhead housing.

Thus (according to yet another aspect) the present invention may provide a method of uninstalling (i.e. removing) (at least part of) a subsea wellhead assembly, the method comprising: removing a suction anchor that forms (at least part of) a subsea well foundation from a seabed together with a high pressure wellhead housing.

The method of uninstalling the subsea wellhead assembly in which the suction anchor and high pressure wellhead housing are removed together may be applicable irrespective of whether the two components were installed together.

The installing and/or uninstalling of the suction anchor may be into or out of a seabed.

In a second aspect, the present invention provides a suction anchor for forming (at least part of) or having previously formed a subsea well foundation, the suction anchor comprising: an outer suction skirt; and an inner member integral with the outer suction skirt, wherein the inner member comprises a high pressure wellhead housing (which may optionally support a wellhead extension pipe to form a, high pressure wellhead housing assembly).

The suction anchor comprising the high pressure wellhead housing may be for sucking into a seabed (or other underwater formation) to form or having formed (at least part of) a subsea well foundation and/or for installing or uninstalling (at least part of) the subsea wellhead assembly (as the suction anchor comprises an inner member that comprises the high pressure wellhead housing and optionally a wellhead extension pipe supported on the high pressure wellhead housing). The suction anchor may be a suction anchor that is to be sucked into the ground, i.e. before the suction anchor is sucked into the ground, or that has previously been sucked into the ground but is now removed, i.e. after the suction anchor has been removed from the ground.

The suction anchor may be a suction anchor that is not (at that point in time) sucked into the ground.

References herein to the seabed/ground unless otherwise made clear may encompass any underwater formation in which a well may be formed.

It has been realised that installation of a subsea well assembly with a suction anchor foundation can be simplified by integrating the high pressure wellhead housing (which may optionally support a wellhead extension pipe to form a, high pressure wellhead housing assembly), with the suction anchor. This is because at least part of the wellhead assembly can be installed when the suction anchor is installed. It has also been realised that removal of a subsea well with a suction anchor foundation can be simplified by removing the high pressure wellhead housing (and wellhead extension pipe if present) together with the suction anchor. This is because at least part of the wellhead can be uninstalled when the suction anchor is uninstalled.

Normally, installing a subsea well with a suction anchor foundation would comprise installing the suction anchor on the seabed and then attaching wellhead components, such as the high pressure wellhead housing assembly to the suction anchor well foundation. Similarly, removing a subsea well that has a suction anchor foundation may have previously comprised removing the wellhead components such as the high pressure wellhead housing/assembly and then in a separate operation, removing the suction anchor.

In the present invention, in the case of installation, because the high pressure wellhead housing is part of the suction anchor and/or prefixed to the suction anchor, there is no need to perform a separate operation of connecting the high pressure wellhead housing to an installed suction anchor.

In the present invention, in the case of removal, because the high pressure wellhead housing is removed with the suction anchor, there is no need to perform a separate operation to remove the suction anchor after the high pressure wellhead housing is removed.

The inner member may comprise a central suction anchor tube. The central suction anchor tube may be part of the suction anchor (i.e. suction can) and be integral with the outer suction skirt. For example the central suction anchor tube may be welded to the suction anchor. This central suction anchor tube may provide the inner wall of the volume within the suction skirt that allows the pressure to be adjusted relative to the external pressure so as to permit a force to be generated that allows the suction anchor to be forced into or out of the seabed. In a typical known arrangement, when a suction anchor is used as a well foundation, the central suction anchor tube may be the pipe into which the conductor, e.g. conductor housing and/or conductor pipe, is landed.

The inner member may comprise a conductor (i.e. conductor housing and and/or conductor pipe).

The inner member of the suction anchor may comprise a low pressure conductor pipe (this may be in addition to or in place of the central suction anchor tube of the suction anchor can). In the case that the conductor pipe is provided in place of the central tube, the suction anchor may comprise an outer suction skirt that is integral with (and may be directly connected to) a low pressure conductor, e.g. conductor housing and/or conductor pipe and/or the high pressure wellhead housing. The high pressure wellhead housing may be provided at least partly within and/or connected to the low pressure conductor (i.e. conductor housing and and/or conductor pipe).

Alternatively, the suction anchor may comprise a central suction anchor tube and the high pressure wellhead housing, and casing (i.e. wellhead extension pipe), if present, may be received, e.g. directly, in the central tube, i.e. the arrangement may not comprise a conductor pipe. In this configuration optionally a conductor housing may be provided between a top part of the central tube and the high pressure wellhead housing so as to hold and support the high pressure wellhead housing (which may optionally support a wellhead extension pipe to form a high pressure wellhead housing assembly). Thus, in another aspect, the present invention may provide a subsea wellhead assembly comprising: a conductor housing, but no conductor pipe.

Thus, the present invention may provide a subsea wellhead assembly comprising a conductor housing, wherein the conductor housing does not support a conductor pipe (i.e. there is no conductor pipe hung from, i.e. located below, the conductor housing). In other words the conductor housing may not be integral with a conductor pipe.

The conductor housing may hold and support (e.g. act as a landing surface for) the high pressure wellhead housing. However, the conductor pipe may not be required because the function of this pipe may be achieved by the central pipe of the suction anchor (if present) and/or the high pressure well casing with the outer suction skirt of the suction anchor.

The high pressure wellhead housing may not support a wellhead housing extension pipe.

Thus, in another aspect, the present invention may provide a subsea wellhead assembly comprising: a wellhead housing, but no wellhead housing extension pipe.

The conductor housing may have the external and/or internal profile of known and/or standard conductor housings such as GE Vetco 30" conductor housing. Thus, the conductor housing may still be regarded as a conductor housing despite the fact that it does not support a conductor pipe.

The suction anchor may comprise a conductor housing that does not support a conductor pipe and a high pressure wellhead housing that does not support a wellhead housing extension pipe. The high pressure wellhead housing that does not support a wellhead housing extension pipe may be landed in the conductor pipe that does not support a conductor pipe. The inner member that provides the internal surface around which the suction volume is formed may be provided by a central suction anchor tube.

Having an arrangement without a conductor pipe and/or a wellhead extension pipe may make the manufacture and installation of the assembly quicker and/or cheaper.

The present invention may provide a suction anchor for forming, or having previously formed, a subsea well assembly, the suction anchor comprising: an outer suction skirt, and an inner member integral with the outer suction skirt, wherein the inner member comprises a high pressure wellhead housing (which may optionally support a wellhead extension pipe to form a high pressure wellhead housing assembly), and a conductor housing, and wherein the suction anchor, i.e. inner member, does not comprise a low pressure conductor pipe and/or a wellhead housing extension pipe.

The present invention may provide a subsea wellhead assembly, the assembly comprising: a suction anchor comprising an outer suction skirt and an inner pipe (e.g. central pipe/tube) connected to the outer suction skirt; a collar located (at least partially or entirely) above the inner pipe; and a high pressure wellhead housing located within and supported by the collar.

The collar may be supported by the suction anchor. The collar may be fixed (e.g. mechanically fixed) such as bolted, clamped, locked and/or glued to the suction anchor.

The collar may be supported such that loads can be transferred from the collar to the suction anchor. The collar (e.g. conductor housing) may be connected near or at a top end and/or near or at a bottom end to the suction anchor. These may be the only connection points/load transmission paths between the collar (e.g. conductor housing) and the suction anchor. This may permit loads to be transferred from the collar to the suction anchor via axially spaced locations. By having these two locations at or towards each end of the collar the two load transmitting connection points may be as far apart as possible.

The collar may be a conductor housing without a conductor pipe attached thereto. The high pressure wellhead housing may not have a wellhead housing extension pipe connected thereto such that it may form a second collar in which a casing hanger and casing may be landed.

The bottom of the collar, e.g. conductor housing, may be received on and supported by a mount (e.g. a mount ring)

that is attached to the suction anchor. For example, the mount may be supported by an inner pipe support on which the inner pipe (e.g. central tube) is directly supported.

The high pressure wellhead housing may be attached to and support a wellhead housing extension pipe, e.g. a high pressure well head casing.

The subsea wellhead assembly may comprise a suction anchor comprising an outer suction skirt connected to a central tube via a connection portion so as to form a sealed annular volume between the central tube and the outer suction skirt.

The connection portion may comprise an inner pipe support, e.g. inner support ring. This inner pipe support may attach to and support central tube of the suction anchor. The central tube may hang from the inner pipe support.

Supported on the inner pipe support may be a mount e.g. mount ring. The mount may provide a landing surface for the collar, i.e. conductor housing.

The conductor housing may be clamped in position on the mount by means of a clamp, e.g. clamp ring that fixes to a top structure of the suction anchor.

The top structure may comprise a plurality of radially extending fins (e.g. in the form of I-beams) that are fixed to the top of the suction anchor via the connection portion and permits loads to be transferred from the high pressure wellhead (such as via conductor housing if present) into the suction anchor.

The suction anchor, e.g. the top structure, may comprise a tubular part that may be termed a conductor housing receptacle. The radially extending fins may be connected to this receptacle and the receptacle may receive the conductor housing. The conductor housing may be mechanically fixed such as bolted, clamped and/or locked into the receptacle.

The conductor housing receptacle may be sized and/or shaped to accommodate many different conductor housings. This may mean that the suction anchor and associated receptacle may be used with conductor housings from different suppliers. Thus the conductor housing receptacle may be an adaptable unit.

The clamp may engage at or near the top end of the conductor housing, e.g. the opposite end to the mount.

The clamp may lock the conductor housing in position relative to the suction anchor and in particular relative to the conductor receptacle, if present.

The conductor housing may hold, support and directly connect to the high pressure wellhead housing. The high pressure wellhead housing may be landed in the conductor housing.

The high pressure wellhead housing may be attached to and support a wellhead extension pipe, e.g. a high pressure wellhead casing.

Thus the wellhead assembly may comprise a central tube of a suction anchor which is immediately around (i.e. without any other intermediate components) a wellhead extension pipe, e.g. a high pressure wellhead head casing. If the high pressure wellhead housing does not support a wellhead extension pipe then the wellhead assembly may comprise a central tube of a suction anchor which is immediately around (i.e. without any other intermediate components) a casing that is supported by a casing hanger landed in the high pressure wellhead housing.

The casing may be the first regular casing operation, i.e. involving drilling operation, and installed after the other components of the suction anchor (which are all installed together). The clamp and mount may each provide a path for loads to be transmitted from the conductor housing to the suction anchor (e.g. the top structure) from where they can be distributed into the seabed.

The subsea wellhead assembly may or may not be installed and/or uninstalled as described above, i.e. the high pressure wellhead housing may or may not be integral with the suction anchor during installation or uninstallation.

It has also been realised that when a subsea well assembly has a foundation formed by a suction anchor that it is not essential for the inner member to comprise a central suction anchor tube or a conductor pipe. If the suction anchor comprises a central suction anchor tube and/or a low pressure conductor pipe the inner member may not comprise a wellhead housing extension pipe.

A typical (prior art) well assembly will comprise a low pressure conductor (i.e. conductor housing and a conductor pipe). A typical (prior art) well assembly will also comprise a high pressure wellhead assembly (i.e. a high pressure wellhead housing and a wellhead housing extension pipe). The low pressure conductor is a well-known structural component that provides reinforcement of the wellbore and/or a conduit for casing. This is a tubular component in which the high pressure wellhead housing and wellhead housing extension pipe is normally installed.

It has been realised that the function of this well-known component can be achieved by a suction anchor foundation (e.g. the outer suction skirt) and thus that the usual low pressure conductor is not essential in a well with a suction anchor foundation. Additionally, it has been realised that the high pressure wellhead housing assembly with a wellhead extension pipe when integral with the suction anchor can perform the function of the central suction anchor tube of the suction anchor. Therefore, the central tube of the suction anchor may not be essential in a well with a suction anchor that has an integral high pressure wellhead housing (e.g. if it is long enough to self-penetrate under gravity), or high pressure wellhead housing assembly. The central tube may also not be essential in a well with a suction anchor with an integral conductor, e.g. conductor housing and conductor casing.

Thus, in another aspect, the present invention may provide a well assembly, the well assembly having a suction anchor that acts as a foundation for the well, wherein the well assembly does not comprise a low pressure conductor and/or a central tube.

In another aspect, the present invention may provide a well assembly, the well assembly having a suction anchor that acts as a foundation for the well, wherein the well assembly does not comprise a wellhead housing extension pipe.

The suction anchor may comprise an outer suction skirt; and an inner member within the outer suction skirt. The inner member may not comprise a low pressure conductor and/or a suction anchor central tube and/or a wellhead housing extension pipe. The inner member may comprise only one of a low pressure conductor pipe, a suction anchor central tube, or a wellhead housing extension pipe. This may make manufacture and installation of the assembly cheaper and/or easier.

The volume within the outer suction skirt of the suction anchor in which the pressure may be adjusted relative to an external pressure so as to exert a force on the suction anchor, may be formed directly between the outer suction skirt and the high pressure wellhead housing assembly, i.e. the wellhead housing extension pipe.

The outer suction skirt may be directly connected to the high pressure wellhead housing, which in turn may be integral with a wellhead housing extension pipe.

The present invention may provide a well assembly, the well assembly having a suction anchor that acts as a foundation for the well, wherein the inner member (i.e. the wellhead within the outer suction skirt) does not comprise a low pressure conductor pipe and/or a central suction anchor tube and/or a wellhead housing extension pipe. The inner member may comprise only one of a low pressure conductor pipe, a suction anchor central tube, or a wellhead housing extension pipe. This may make manufacture and installation of the assembly cheaper and/or easier.

Whilst in the present invention the outer suction skirt may assume the function of a usual low pressure conductor pipe in a wellhead assembly, this does not make it a low pressure conductor in the sense that this term in understood in this art. Similarly, whilst the low pressure conductor pipe (if present) or the high pressure wellhead housing, or high pressure wellhead housing assembly (if the low pressure conductor pipe is not present) may perform the function of a usual central suction anchor tube, this does not make it a central suction anchor tube in the sense that this term in understood in this art. Thus, the suction anchor for forming the subsea well assembly (and specifically the inner member) may not comprise a low pressure conductor pipe and/or a central suction anchor tube.

The suction anchor may comprise a high pressure wellhead housing that is directly connected to the suction anchor (e.g. without the presence of an intermediate conductor pipe and/or housing). The suction anchor may comprise a high pressure wellhead housing that is directly connected to the suction anchor without the presence of an intermediate conductor pipe but with the presence of a conductor housing.

Once the suction anchor is installed on the seabed, the function of the usual low pressure conductor pipe (which may not be present in the subsea wellhead assembly) may be provided by the suction anchor, e.g. the outer suction skirt of the suction anchor.

The inner member of the suction anchor may consist of the high pressure wellhead housing assembly, i.e. a high pressure wellhead housing and a wellhead housing extension pipe.

The present invention may provide a suction anchor for forming a subsea well foundation, wherein the suction anchor comprises an outer suction skirt and an inner member connected to the outer suction skirt, wherein the inner member of the suction anchor is a high pressure wellhead housing (which may optionally support a wellhead extension pipe to form a high pressure wellhead housing assembly).

The inner member may be made of a high pressure wellhead housing or a high pressure wellhead housing assembly. The top part of the inner member (the part of the inner member that is nearer the surface of the water compared to the bottom part of the inner member in use) may be formed from a high pressure wellhead housing and the lower part of the inner member may be formed from an extension piece. The extension piece may be fixed (e.g. rigidly and/or permanently) to the high pressure wellhead housing such as by welding.

The extension piece may provide lateral and/or axial support to the high pressure wellhead housing.

The inner member may be an elongate (i.e. its length may be significantly more than the width) member. The inner member may be referred to as a pipe for a well. In use a well may extend through the inner member.

The inner member (which may be or comprise a high pressure wellhead housing assembly, e.g. a high pressure wellhead housing and optionally a wellhead housing extension pipe) may protrude from the top of the suction anchor outer skirt.

The well as referred to in the present specification may be an oil and/or gas well (such as an oil and/or gas producing well). The well may be an injection well for injecting gas or water. For example, the well may be a disposal injection well. The well may be a well for injecting $CO_2$ for storage into an underground formation.

The high pressure wellhead housing being integrated with the suction anchor may mean that it is fixed to the suction anchor such that it can be installed and/or uninstalled together with the suction anchor. The high pressure wellhead housing may be permanently fixed to the suction anchor. Alternatively, it may be a releasable connection between the high pressure wellhead housing and the suction anchor. The high pressure wellhead housing may be rigidly fixed to the suction anchor.

The high pressure wellhead housing may be formed as one piece with the suction anchor. Alternatively the high pressure wellhead housing may be welded, bolted, screwed, cemented, glued and/or fixed or adjoined directly or indirectly by any other known means to the suction anchor.

The high pressure wellhead housing may be directly connected or attached to the suction anchor (e.g. the outer suction skirt of the suction anchor) or it may be attached via another component such as a low pressure conductor housing.

The high pressure wellhead housing may be part of the suction anchor.

The inner member may be coaxial with the outer suction skirt. The outer suction skirt may be located about the inner member. The outer suction skirt and the inner member may be concentric.

The volume between the inner member and the outer suction skirt and/or the volume within the inner member may be a volume in which the pressure can be adjusted (e.g. reduced or increased) to allow the suction anchor to be sucked into the seabed during installation or pushed out of the seabed during removal. The pressure in the volume between the inner member and the outer suction skirt and the pressure in the volume within the inner member may be independently controllable.

The inner member (e.g. high pressure wellhead housing, or high pressure wellhead housing assembly) may be connected to the outer suction skirt in a pressure tight manner. This is so as to permit the pressure in the volume between the outer suction skirt and the inner member to be adjusted relative to the pressure outside of this volume.

The inner member and outer suction skirt may be attached/connected to each other. This connection may be a rigid and/or structural connection.

For example, the outer suction skirt and the inner member may be connected by a connection portion. The outer skirt, inner member and connection portion may together form the volume in which the pressure can be adjusted to allow the suction anchor to be forced into or out of the ground. The volume may be an annular volume around the outside of the inner member.

The connection portion may be an annular plate. The connection portion may extend between the inner member (e.g. the top of the inner member) and the outer suction skirt (e.g. the top of the outer suction skirt).

The suction anchor may be a tall steel cylindrical structure that is open at the bottom and closed at the top.

A suction anchor may be referred to as, and may encompass, a suction caisson, a suction pile, a suction bucket and/or a suction can.

The method of installation and/or removal of the subsea foundation of any aspect of the invention may comprise providing one or more of the features of the above described suction anchor.

The method of installing the suction anchor and/or wellhead may comprise moving the suction anchor towards a seabed until the outer suction skirt reaches the seabed; allowing the suction anchor to penetrate the seabed; and/or sucking the suction anchor into the seabed.

The lowering and/or penetration of at least part of the inner member and/or outer suction skirt may be under the action of gravity.

The weight of the suction anchor and, if present, any optional additional weight (e.g. temporary dummy weights and holding devices) may force (i.e. gravity may pull) a portion of the inner member and the outer skirt into the seabed.

The suction anchor may be installed by first lowering it into the soil to a self-penetration depth (i.e. penetration due to submerged weight). The remainder of the required penetration may be achieved by pumping out the water trapped inside the suction anchor.

The method of removing the suction anchor and/or wellhead may comprise pushing the suction anchor out of the seabed. This may be achieved by increasing the pressure inside the volume to force the suction anchor out of the seabed.

The method of removing the subsea wellhead may comprise disconnecting the lower part of the well in the seabed from the suction anchor and wellhead before forcing the suction anchor out of the seabed.

The suction anchor and wellhead may be disconnected from the lower part of the well by creating a break in the conduits (e.g. casing(s) and/or liner(s)) below the seabed. The break may be at a location that is a depth of between 0 and 10 times the diameter of the suction anchor below the suction anchor. The disconnection may be achieved by cutting, eroding or dissolving for example the conduits.

The method of removing the subsea well assembly may comprise closing the well (e.g. with cement) before the removal operation begins.

The suction anchor may comprise a device, such as a pump, for adjusting the pressure inside the volume (e.g. reducing for providing the suction force during installation or increasing for providing the push force during removal). The suction anchor may comprise a device, such as a valve, for controlling pressure inside the volume (for controlling the suction/pushing force).

The suction anchor may be supported during installation or removal. The suction anchor may be supported by deployment apparatus. The deployment apparatus may comprise wires, winches, buoys, and chains for example. The suction anchor may be lowered towards the seabed during installation or raised away from the seabed during removal.

It has been realised that when the suction anchor is installed or removed together with the integral high pressure wellhead housing that the high pressure wellhead housing can be used to aid installation or removal of the suction anchor. It has been realised that the high pressure wellhead housing can be used as a lifting/connection point for deployment or removal apparatus.

Thus, the suction anchor may be supported and lowered or raised using a device (or a plurality of devices in series) connected to the high pressure wellhead housing.

This connection may be a direct connection. Alternatively there may be an indirect connection, e.g. an intermediate component acting as a connector between the device and the high pressure wellhead housing.

The suction anchor may be held/supported via the high pressure wellhead housing during installation or removal.

The suction anchor may be entirely held/supported via the high pressure wellhead housing. Alternatively this may be additional to some other deployment apparatus, such as wires, winches, buoys, and chains connected to other parts of the suction anchor.

The device may be any known lifting or handling tool that fits the wellhead top profile.

For example, the device may be a well control device (such as a blow out preventer (BOP)), a Christmas tree (which may also be referred to as a subsea tree), a capping stack etc.

Thus for a suction anchor with an integral high pressure wellhead housing a device such as a BOP, subsea tree or capping stack may be used as an installation and/or removal tool.

The present invention may provide a subsea wellhead installation and/or removal apparatus, the well installation apparatus comprising the above described suction anchor with an integral high pressure wellhead housing and a device connected to the high pressure wellhead housing for permitting the suction anchor to be deployed (e.g. lowered or lifted) subsea.

In the case of installation, the method may comprise connecting the device to the high pressure wellhead housing to form a subsea well installation assembly (the subsea well installation assembly may comprise the suction anchor with integral high pressure wellhead housing, or high pressure wellhead housing assembly discussed above, connected to the device). The method may comprise lowering the subsea well installation assembly towards the seabed. The subsea well installation assembly may be supported and lowered under the action of gravity (e.g. its own weight). The subsea well installation assembly may reach the seabed and penetrate the seabed under its own weight. Because the assembly comprises the device, e.g. BOP, the assembly is heavier and thus the distance that the suction anchor will penetrate the seabed may be greater than a suction anchor without the device.

Thus the device, e.g. BOP, may provide significant mass that may be used to permit gravity driven penetration of the suction anchor into the seabed. This may allow the suction anchor to penetrate the seabed further before it is necessary, if it is necessary at all, to apply suction to the suction anchor to pull it further into the seabed.

In the case of removal, the method may comprise connecting the device to the high pressure wellhead housing to form a subsea well removal assembly (the subsea well removal assembly may comprise the suction anchor with high pressure wellhead housing discussed above, connected to the device). The method may comprise raising the subsea well removal assembly away from the seabed.

The device connected to the high pressure wellhead housing (e.g. a BOP) may also act as the device for adjusting (e.g. arranged to adjust) the pressure inside the suction anchor and/or inside the inner member to facilitate installation or removal.

The device connected to the high pressure wellhead housing (e.g. a BOP) may be in contact with rig utilities, e.g. via a riser. Therefore this device may be used to establish the differential pressure inside the suction anchor that results in it being forced into or out of the seabed.

Thus a fluid connection may be formed between the device (e.g. a BOP) connected to the high pressure wellhead housing and the inner volume of the suction anchor. This fluid connection may be a suction line.

The device connected to the high pressure wellhead housing (e.g. a BOP) may have a remote release/engage functionality in the connection to the high pressure wellhead housing.

The device connected to the high pressure wellhead housing (e.g. a BOP) may comprise pressure sensor that may permit the pressure in the suction anchor to be monitored.

The device connected to the high pressure wellhead housing (e.g. a BOP) may comprise means for measuring verticality. In the case of an installation method, the method may comprise measuring the verticality of the device connected to the high pressure wellhead housing. This may be achieved using a means for measuring verticality that is provided in the device itself. This means that the verticality of the high pressure wellhead housing (that will dictate at least in part the verticality of the final well) can be effectively measured.

The device (e.g. a BOP) connected to the high pressure wellhead housing and/or an associated riser or rig may have means to control the verticality of the device (e.g. a BOP) connected to the high pressure wellhead housing and/or the suction anchor. Thus, in the case of an installation method, the method may comprise controlling the verticality of the device connected to the high pressure wellhead housing. This may be before the suction anchor is sucked into the seabed. This may be achieved using a means provided in the device itself, in an associated riser or in the rig. This means that it may be ensured that the suction anchor and high pressure wellhead housing (and hence final well) are at the desired orientation before the suction anchor is sucked into the seabed.

When the device connected to the high pressure wellhead housing (e.g. a BOP) is used as the installation tool, another stage of the installation method (i.e. landing of the subsea wellhead equipment on the high pressure wellhead housing) may be removed. Thus, for example when the device connected to the high pressure wellhead housing is a well control device, e.g. a BOP, drilling of the first section of the well may be the first step after the suction anchor has been sucked into the ground.

Similarly, when the device connected to the high pressure wellhead housing (e.g. a BOP) is used as the removal tool, another stage of the removal method (i.e. removal of the subsea wellhead equipment on the high pressure wellhead housing) may be removed.

The present invention is applicable to a single suction anchor and/or a suction anchor connected to other suction anchors (i.e. an arrangement with a plurality of suction anchors).

The above discussion of features and optional features applies to all aspects of the invention.

Certain preferred embodiments of the present invention will now be described by way of example only with reference to the accompanying drawings, in which.

Figure 1:
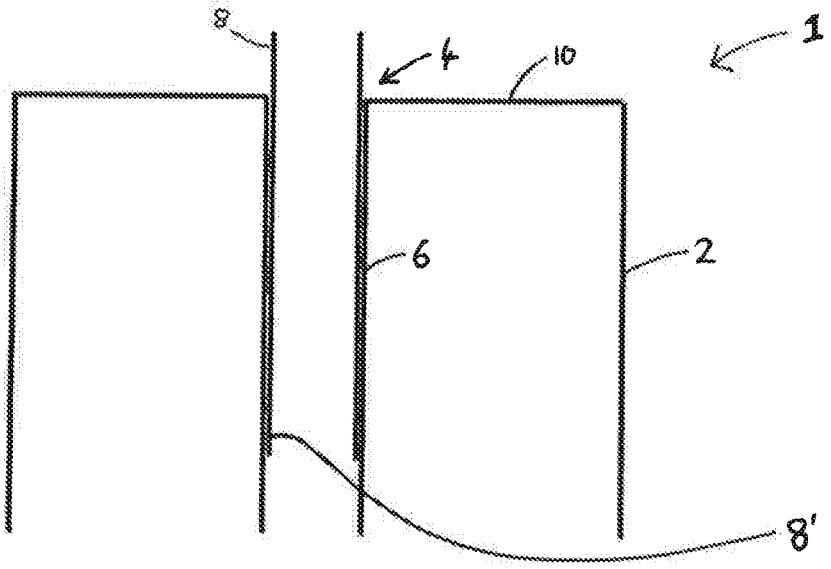
FIG. 1 is a schematic of a suction anchor.

FIG. 1 shows a suction anchor 1 with an outer suction skirt 2 and an inner member 4. The inner member 4 is made up of a central tube 6 and a high pressure wellhead housing 8 that may support a wellhead housing extension pipe 8'. The central tube 6 may be a tube of the suction anchor 1 into which the high pressure wellhead housing 8 is located and fixed or it may be a conventional low pressure conductor, made up of a conductor housing and a conductor pipe which is connected to the outer suction skirt 2. The central tube 6 could also comprise both a central tube of the suction anchor 1 and a conventional low pressure conductor pipe (although this is not shown in these figures). The inner member 4 is connected to the outer suction skirt 2 by means of a connection portion 10 which may be in the form of an annular plate.

The high pressure wellhead housing may be connected or fixed to the central tube 6 such that it is integral therewith. The high pressure wellhead housing 8 may be connected to the central tube 6 via a conductor housing 30 as shown for example in FIG. 8. The conductor housing 30 however may not be attached to and/or may not support a conductor pipe.

The suction anchor 1 is arranged so that the high pressure wellhead housing 8 can be installed and/or removed with the rest of the suction anchor 1 into or from a seabed.

The outer suction skirt 2, central tube 6 and connection portion 10 may together form an annular volume in which the pressure can be adjusted relative to the environment outside the suction anchor 1. This permits the suction anchor 1 to be forced into or out of the seabed during installation or removal.

Additionally or alternatively, the volume inside the high pressure wellhead housing 8 may be able to be adjusted during installation or removal of the suction anchor 1.

Figure 2:
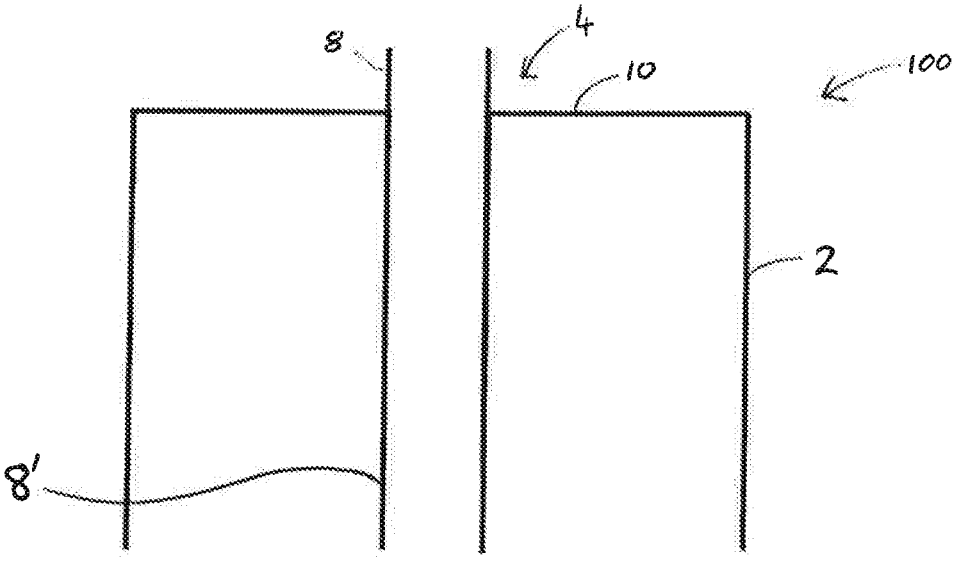
FIG. 2 is a schematic of another suction anchor.

FIG. 2 shows an alternative suction anchor 100. This suction anchor 100 is the same as the suction anchor 1 shown in FIG. 1 except that it does not comprise central tube 6.

In this suction anchor 100 the high pressure wellhead housing 8 is directly connected (although again this may be via a conductor housing) to the outer suction skirt 2 and directly with the suction skirt 2 forms the volume in which pressure can be adjusted relative to the external environment. Aside from this, the above description of the suction 1 is equally applicable to the suction anchor 100 shown in FIG. 2.

The suction anchor 100 does not comprise a low pressure conductor pipe. However, despite not comprising a conductor pipe it may comprise a conductor housing. In use, the outer suction skirt 2 may achieve the structural support functions usually provided by a lower pressure conductor pipe.

FIGS. 3 to 6 show various stages of an installation and/or removal method of a subsea wellhead assembly. Whilst the suction anchor 1 shown in these figures is the suction anchor 1 as shown in FIG. 1, it could equally be the suction anchor shown in FIG. 2, 8 or 9. Thus, the following description of the installation and/or removal method is equally applicable irrespective of whether the suction anchor 1 or 100 is as shown in FIG. 1, FIG. 2, FIG. 8 or FIG. 9.

The method of installation and/or removal involves installing or removing the high pressure wellhead housing 8 and the suction anchor 1 together in one step. The high pressure wellhead housing 8 is integral (e.g. fixed or connected to the outer suction skirt 2, directly or indirectly) with the suction anchor 1 to permit the components to be installed and/or removed together.

Figure 3:
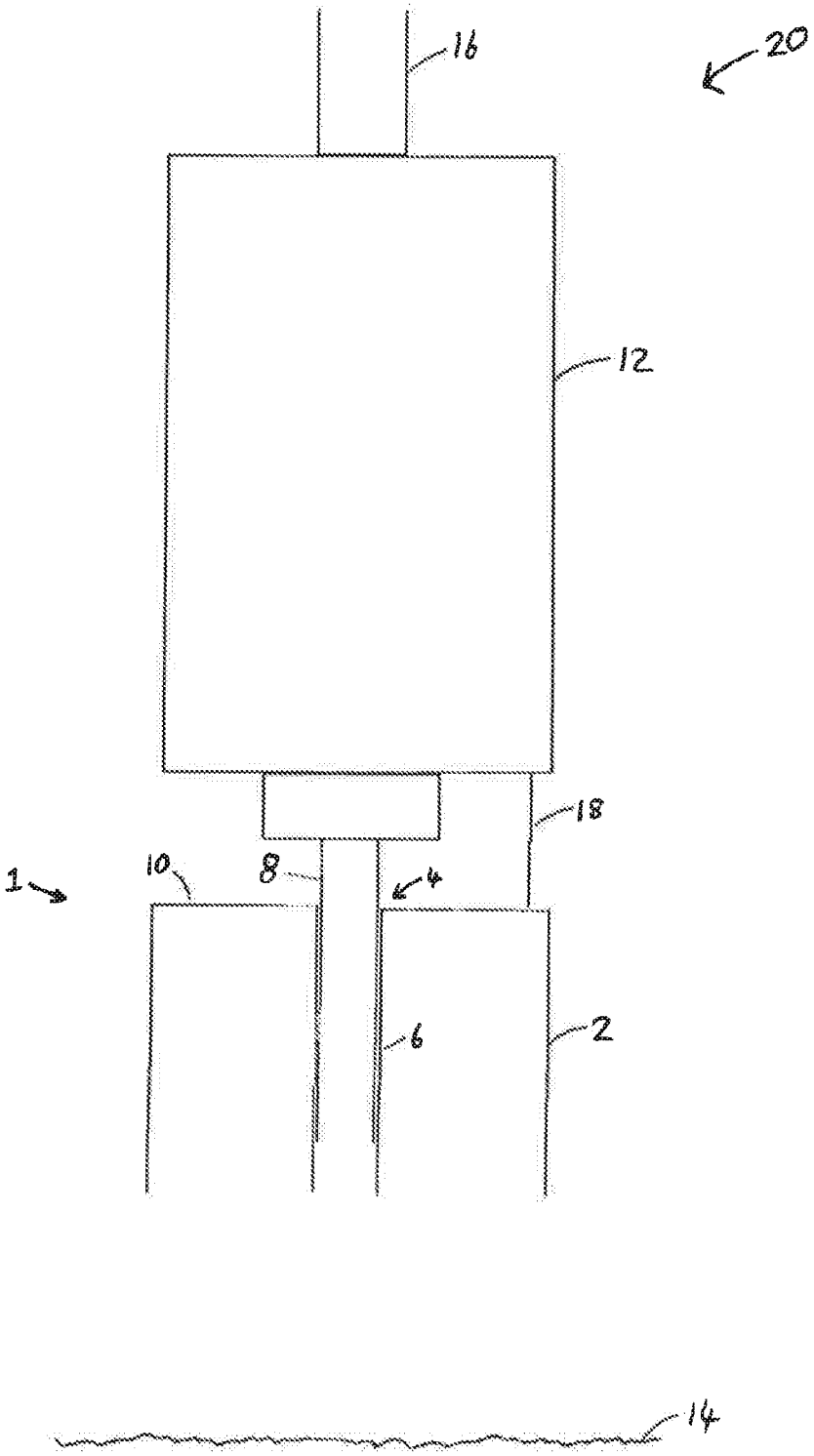
FIGS. 3 to 6 show various stages of an installation and/or removal method.
Figure 4:
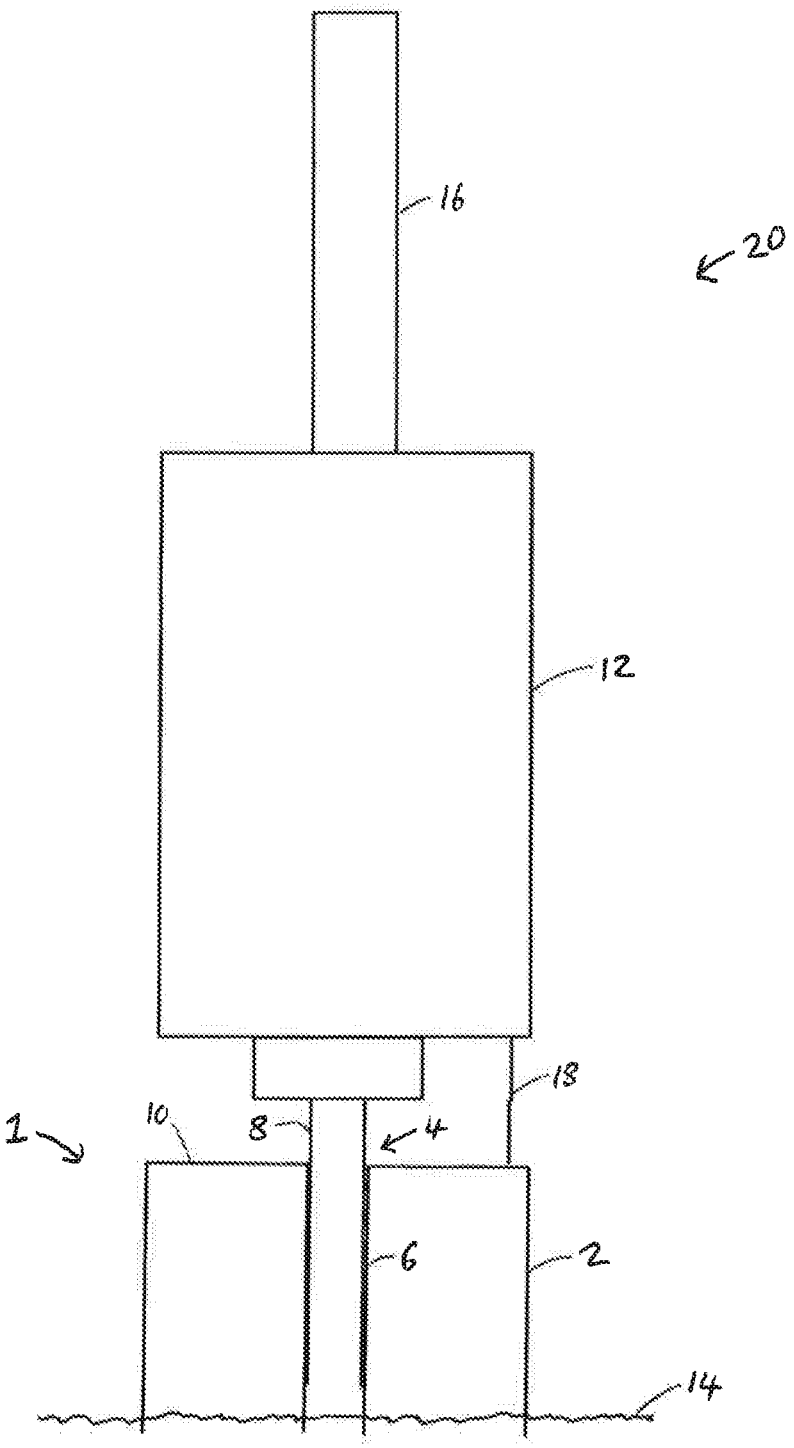

As shown in FIG. 3, the suction anchor 1 with the integral high pressure wellhead housing 8 may be arranged so that the suction anchor 1 can be lifted or lowered by a device 12 (e.g. a well control device (such as a blow out preventer (BOP)), a Christmas tree (which may also be referred to as a subsea tree), a capping stack etc.) that is connected to the high pressure wellhead housing 8.

The device 12 and suction anchor 1 with high pressure wellhead housing 8 may together form what is regarded as a subsea wellhead installation and/or removal assembly 20.

The device 12 may be used to hold/support the suction anchor 1. The suction anchor 1 may optionally also be supported by other means such as wires or chains but these are not shown in the figures.

Figure 5:
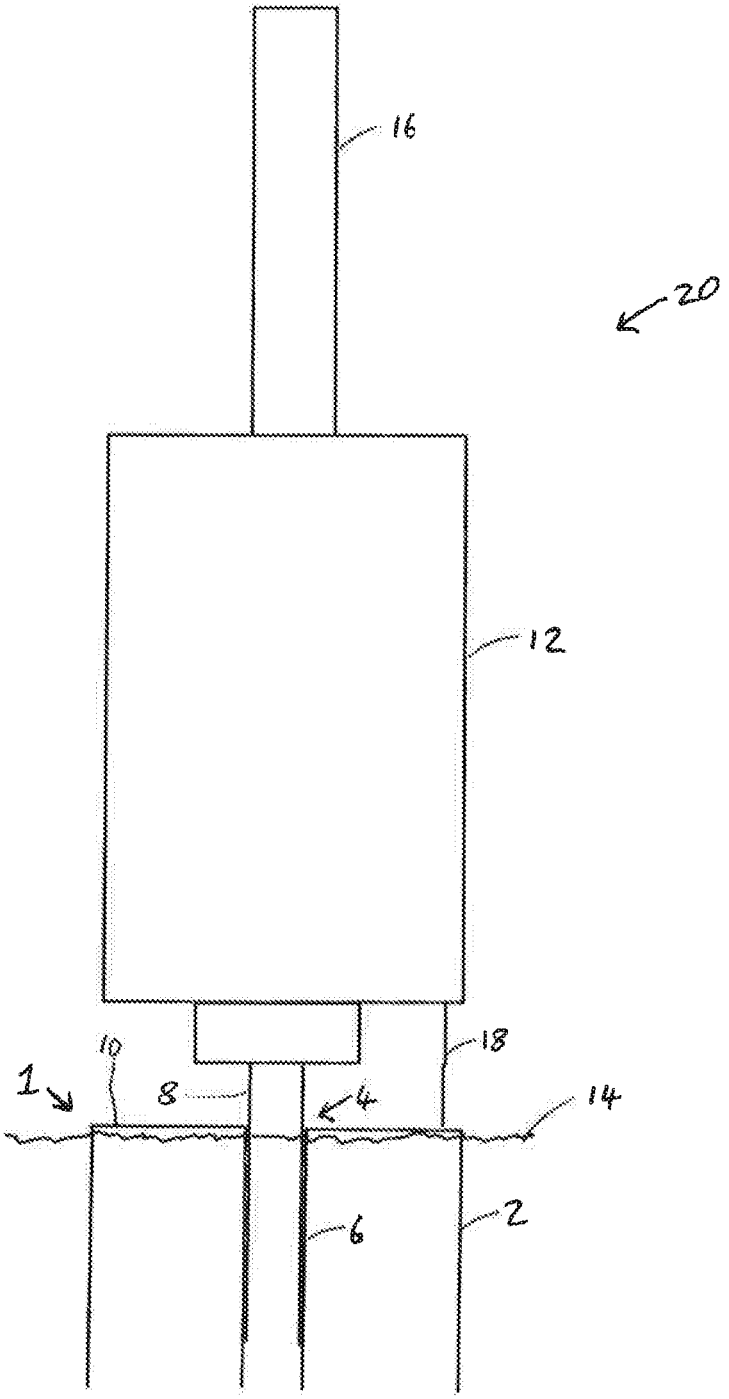

During installation the assembly 20 may be lowered under the action of gravity. Due to the weight of the assembly 20 the suction anchor and the inner member 4 may penetrate the seabed 14 and thus form a closed volume within the suction anchor suction skirt 2 and/or within the high pressure wellhead housing 8 (as shown for example in FIG. 4). The pressure may then be reduced inside the volume so as to force the suction anchor 1 into the seabed 14 as shown in FIG. 5. Alternatively, the assembly 20 may penetrate sufficiently under its own weight and the weight of the device 12 such that suction to pull the suction anchor into the sea bed is not necessary.

The device 12 connected to the high pressure wellhead housing 8 (e.g. a BOP) may be in contact with rig utilities, e.g. via a riser 16.

The device 12 may be used to establish a differential pressure inside the suction anchor 1 that results in it being forced into (or in the case of removal, forced out of) the seabed as shown for example in FIG. 5.

Thus a fluid connection 18 may be formed between the device 12 connected to the high pressure wellhead housing 8 and the inner volume(s) of the suction anchor 1. This fluid connection 18 may be a line, such as a suction line.

Figure 6:
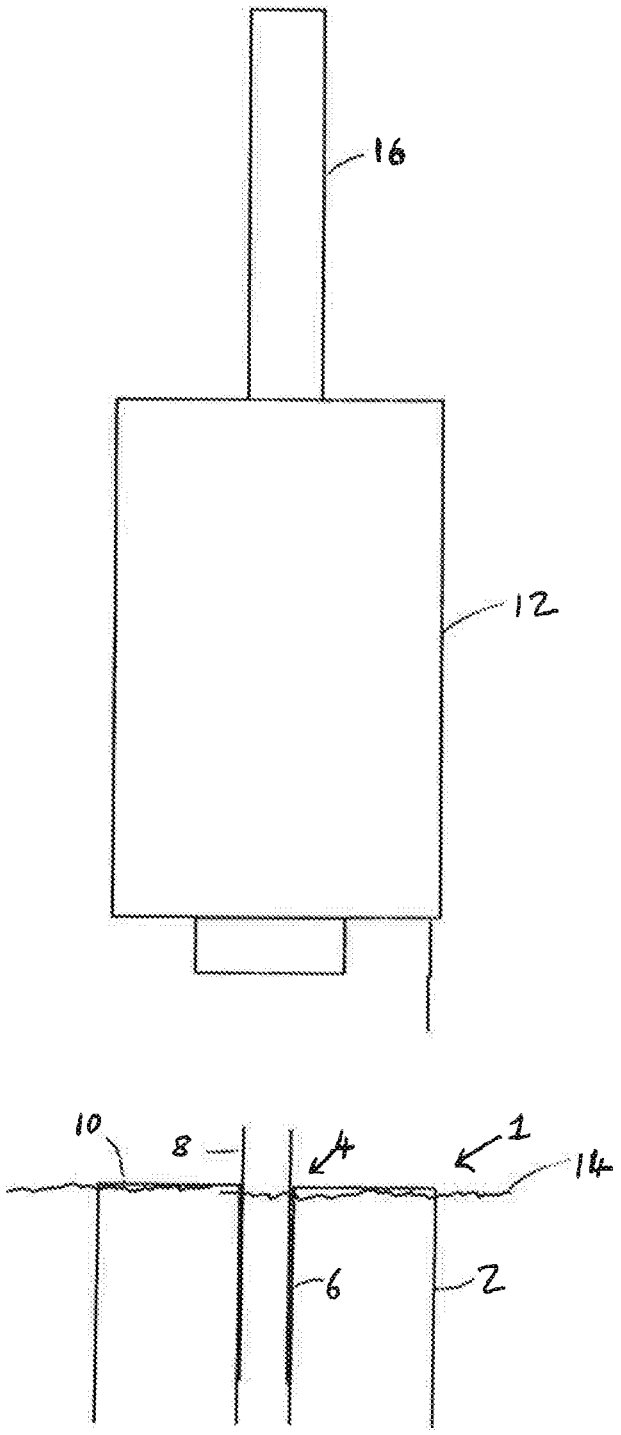

After the suction anchor 1 is installed, the device 12 may either be left attached to the high pressure wellhead housing 8 and used during operation of the well, or it may be detached and removed as shown in FIG. 6.

The removal method may effectively be the opposite of the installation method.

The removal method may comprise attaching a device 12 to a high pressure wellhead housing 8 (in the case that the device 12 is not already connected to the high pressure wellhead housing 8). The method may comprise increasing the pressure inside the suction anchor outer suction skirt 2 and/or the high pressure wellhead housing 8 so as to force the suction anchor 1 out of the seabed 14. As with the installation method, this pressure adjustment may be achieved by the device 12 such as by a line 18.

Once the suction anchor 1 has been forced (at least partially or entirely) out of the seabed 14, the device 12 may be used to lift the suction anchor 1 and high pressure wellhead housing 8 together to the surface.

Figure 7:
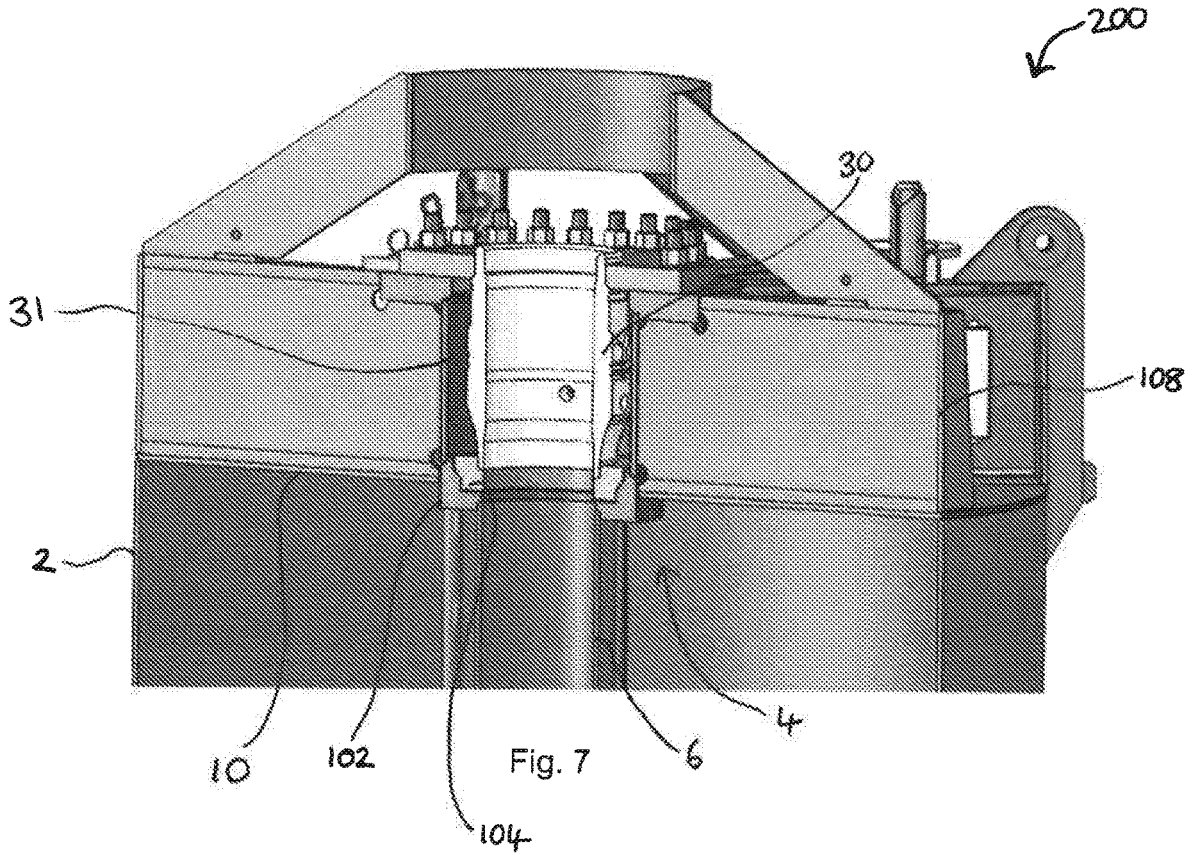
FIG. 7 shows part of a subsea well assembly.

FIG. 7 shows part of a subsea well assembly 200. This assembly 200 may or may not be installed according to the above described method. The subsea well assembly 200 comprises a conductor housing 30, but no conductor pipe.

The assembly 200 comprises a suction anchor comprising an outer suction skirt 2 connected to a central tube 6 via a connection portion 10 so as to form a sealed annular volume between the central tube 6 and the outer suction skirt 2. The connection portion 10 may comprise an inner pipe support ring 102.

This inner pipe support ring 102 may attach to and support central tube 6 of the suction anchor. The central tube 6 may hang from the inner pipe support ring 102.

Supported on the inner pipe support ring 102 may be a mount ring 104. The mount ring 104 may provide a landing surface for conductor housing 30.

The conductor housing 30 is received in a conductor housing receptacle 31. The conductor housing receptacle 31 is a tubular part in which the conductor housing 31 is received and mechanically fixed within.

The conductor housing 30 may be clamped in position on the mount ring 104 by means of a clamp ring 106 that fixes to a top structure 108 of the suction anchor, the top structure 108 comprising a plurality of radially extending fins that are fixed to the top of the suction anchor can via connection portion 10. The radially extending fins of the top structure 108 connect to the conductor housing receptacle 31 such that forces can be transmitted from the receptacle into the top structure 108.

The conductor housing 30 is not attached to and does not support a conductor pipe. However, the conductor housing may have the external and/or internal profile of known and/or standard conductor housings such as GE Vetco 30" conductor housing.

Figure 8:
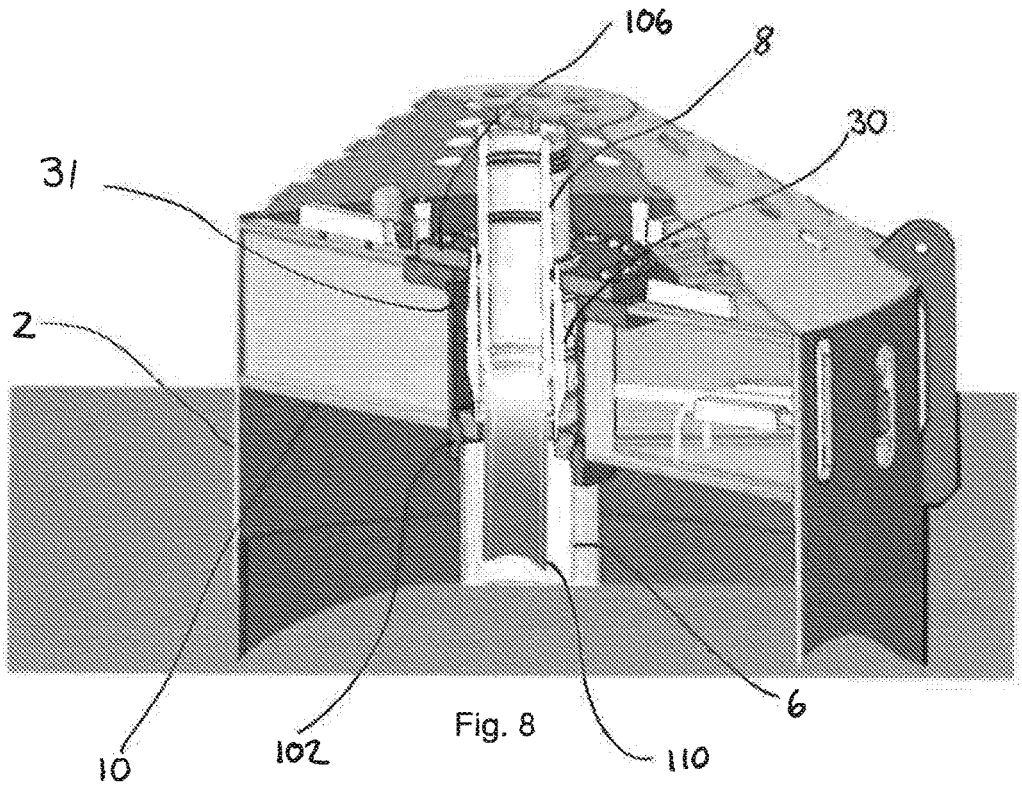
FIG. 8 shows another subsea well assembly.

The conductor housing 30 may hold, support and directly connect to high pressure wellhead housing 8 as shown for example in FIG. 8.

The high pressure wellhead housing 8 may be attached to and support a wellhead extension pipe such as high pressure wellhead casing 110.

Thus the wellhead assembly may comprise a central tube 6 of a suction anchor which is immediately around (i.e. without any other intermediate components) a high pressure wellhead head casing 110.

The clamp ring 106 and mount ring 104 may each provide a path for loads to be transmitted from the conductor housing 30 to the suction anchor (e.g. top structure 108 and/or conductor housing receptacle 31) from where they can be distributed into the seabed.

Figure 9:
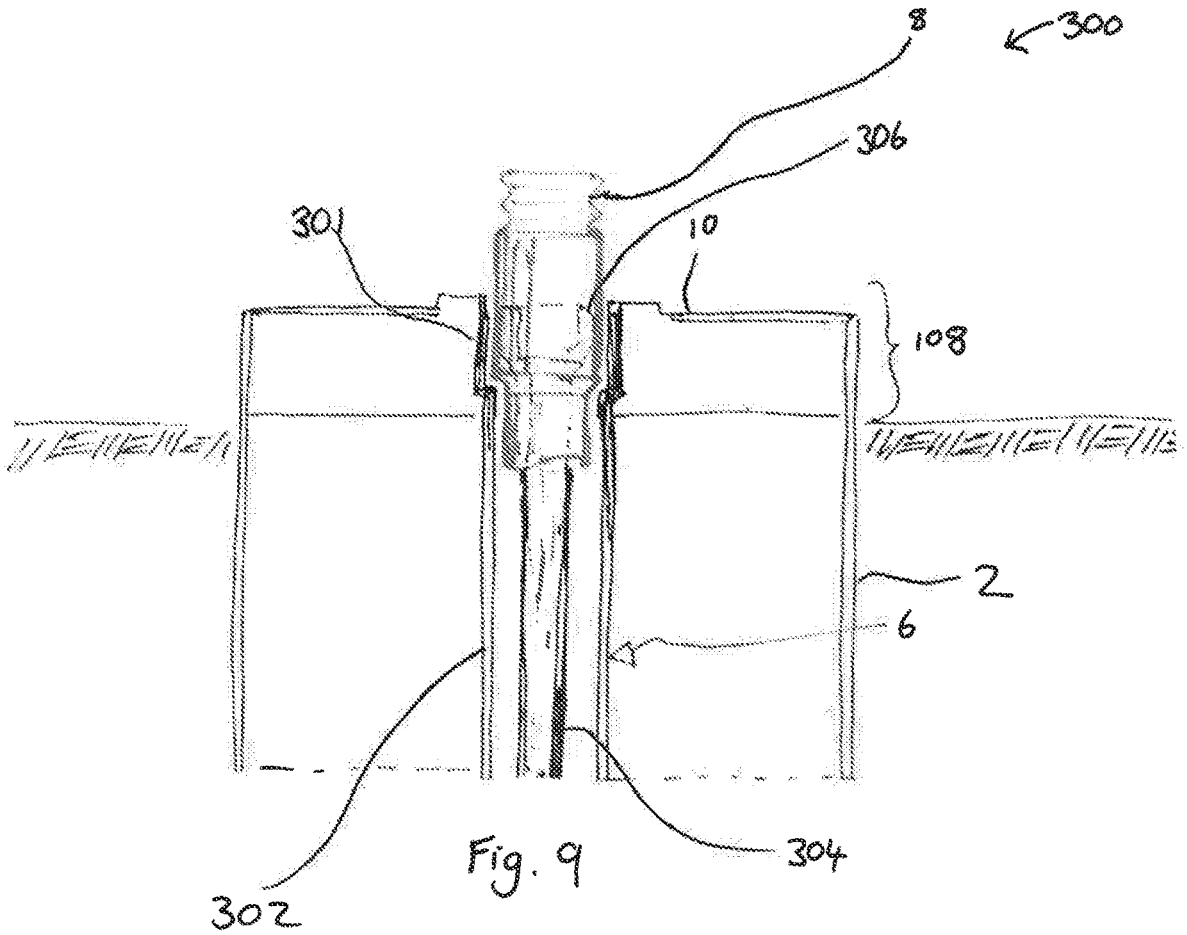
FIG. 9 shows a schematic of yet another subsea well assembly

FIG. 9 shows schematically part of a subsea well assembly 300. This assembly 300 may or may not be installed according to the above described method.

The assembly 300 comprises a suction anchor comprising an outer suction skirt 2 connected to a central tube 6 via a connection portion 10 so as to form a sealed annular volume between the central tube 6 and the outer suction skirt 2.

The connection portion 10 is integrally formed with a conductor housing 301. This housing 301 may not have the usual outer profile of a conductor housing (as it is integral with the top structure 108) but it may have an inner profile of a conductor housing such that the high pressure wellhead housing 8 can be landed within it. Supported on the integral conductor housing 301 may be a conductor pipe 302. This integral conductor pipe 302 may form the inner member 6 around which the annular volume of the suction anchor is formed.

The wellhead housing 8 may be landed in the conductor housing 302 and this may be done before the assembly 300 is deployed subsea.

Once deployed subsea a bore may be drilled through the centre pipe 6 of the assembly and cased with a casing 304. The casing 304 may be supported by a casing hanger 306 that is landed in the high pressure wellhead housing 8. This casing may be a 13⅜" casing and may be regarded as the first "regular" casing that is run by the rig after drilling.

The wellhead housing 8 may not support a wellhead housing extension pipe. Thus, the conductor pipe 302 may immediately surround (i.e. with no other intermediate components) the casing 304.

The invention claimed is:

1. A suction anchor for forming, or having previously formed, a subsea well assembly at an upper end of a subsea well and with the well extending through the suction anchor, the suction anchor comprising:

an outer suction skirt; and an inner member integral with the outer suction skirt, wherein the inner member comprises a conductor housing and a high pressure wellhead housing but does not comprise a low pressure conductor pipe, and the conductor housing holds and supports the high pressure wellhead housing, and wherein the outer suction skirt and the inner member are positioned relative to each other so that any casing strings or pipes hung from the high pressure wellhead housing extend through the volume surrounded by the outer suction skirt.

2. The suction anchor according to claim 1, wherein the inner member does not comprise a central suction anchor tube.

3. The suction anchor according to claim 1, wherein the inner member of the suction anchor comprises a wellhead housing extension pipe.

4. The suction anchor according to claim 1, wherein the conductor housing is received within a conductor housing receptacle and is mechanically fixed to the suction anchor within the conductor housing receptacle.

5. A subsea wellhead installation and/or removal apparatus, the wellhead installation apparatus comprising a suction anchor according to claim 1 and a device connected to the high pressure wellhead housing for permitting the suction anchor to be lowered and/or lifted subsea, wherein the device is a well control device, a subsea tree or a capping stack.

6. The subsea wellhead installation and/or removal apparatus according to claim 5, wherein the device further comprises at least one of a device for adjusting the pressure inside the suction anchor, or a verticality measuring and controlling device.

7. A method of installing or uninstalling a subsea wellhead assembly, the method comprising:

providing a suction anchor according to claim 1 that in use acts as a subsea well foundation located at an upper end of a subsea well and with the well extending through the suction anchor; and installing or uninstalling the suction anchor together with the high pressure wellhead housing on or from a seabed.

8. The method according to claim 7, wherein the method comprises connecting a device to the high pressure wellhead housing such that the suction anchor is held by the device connected to the high pressure wellhead housing during installation or uninstallation, and wherein the device is a well control device, a subsea tree or a capping stack.

9. The method according to claim 8, wherein the device connected to the high pressure wellhead housing is further comprises at least one of a device for adjusting the pressure inside the suction anchor, or a device for measuring and controlling the verticality of the device connected to the high pressure wellhead housing.

10. The suction anchor according to claim 1, wherein the suction anchor further comprises a top structure, wherein the top structure comprises a plurality of radiating fins that are fixed to the top of the suction anchor, and the fins are in the form of I-beams.

11. A subsea wellhead assembly located at an upper end of a subsea well, the subsea well head assembly comprising:

a conductor housing;

a suction anchor comprising an outer suction skirt and an inner pipe connected to the outer suction skirt, wherein the conductor housing does not support a conductor pipe, wherein the assembly does not comprise a conductor pipe, wherein the conductor housing is supported by the suction anchor such that loads can be transferred from the conductor housing to the suction anchor, and wherein the conductor housing is located above the inner pipe.

12. The subsea wellhead assembly according to claim 11, wherein the assembly comprises a high pressure wellhead housing and wherein the high pressure wellhead housing is located within and supported by the conductor housing, and wherein the high pressure wellhead housing is attached to and supports a wellhead extension pipe.

13. The subsea wellhead assembly according to claim 11, wherein the conductor housing is connected near or at its top end and near or at its bottom end to the suction anchor.

14. The subsea wellhead assembly according to claim 11, wherein the conductor housing is received in a conductor housing receptacle and mechanically fixed to the suction anchor.

15. The subsea wellhead assembly according to claim 11, wherein a bottom of the conductor housing is received on and supported by a mount attached to the suction anchor, and wherein the conductor housing is locked in position relative to the suction anchor via a clamp, and wherein the clamp and mount each provide a path for loads to be transmitted from the conductor housing to the suction anchor.

16. The subsea wellhead assembly according to claim 11, wherein a high pressure wellhead housing is landed in the conductor housing, and wherein the high pressure wellhead housing does not support a wellhead housing extension pipe.

17. A subsea wellhead assembly located at an upper end of a subsea well comprising:

a high pressure wellhead housing; and a suction anchor comprising an outer suction skirt and an inner pipe connected to the outer suction skirt, wherein the high pressure wellhead housing does not support a wellhead housing extension pipe, wherein a casing hanger that supports a casing is landed in the high pressure wellhead housing, and wherein the inner pipe of the suction anchor is immediately around the casing.

18. The subsea wellhead assembly according to claim 17, wherein the high pressure wellhead housing is located within and supported by a conductor housing, and wherein the conductor housing does not support a conductor pipe.

* * * * *